US012404071B1

(12) United States Patent
Wu et al.

(10) Patent No.: US 12,404,071 B1
(45) Date of Patent: Sep. 2, 2025

(54) TAMPER-EVIDENT CONTAINER WITH ROTATING LID

(71) Applicant: YI SHEN PLASTIC CORP., Changhua County (TW)

(72) Inventors: Chun-Hsien Wu, Changhua County (TW); Chun-Ye Wu, Changhua County (TW)

(73) Assignee: YI SHEN PLASTIC CORP., Changhua County (TW)

( * ) Notice: Subject to any disclaimer, the term of this patent is extended or adjusted under 35 U.S.C. 154(b) by 0 days.

(21) Appl. No.: 18/769,441

(22) Filed: Jul. 11, 2024

(30) Foreign Application Priority Data

May 15, 2024 (TW) ..... 113117848

(51) Int. Cl.
*B65D 17/32* (2006.01)
*B65D 17/00* (2006.01)
*B65D 55/02* (2006.01)

(52) U.S. Cl.
CPC ..... *B65D 17/32* (2018.01); *B65D 17/02* (2013.01); *B65D 55/02* (2013.01)

(58) Field of Classification Search
CPC ..... B65D 43/162; B65D 43/16; B65D 43/02; B65D 43/0235; B65D 43/0237; B65D 43/0239; B65D 43/0254; B65D 1/34; B65D 2401/15; B65D 2401/25; B65D 2401/35; B65D 2401/10; B65D 55/06
See application file for complete search history.

(56) References Cited

U.S. PATENT DOCUMENTS

2013/0160406 A1* 6/2013 Johnston ..... B65B 7/26 220/268
2017/0057706 A1* 3/2017 Wang ..... B65D 43/0254
2021/0016936 A1* 1/2021 Hsieh ..... B65D 55/06
2022/0250808 A1* 8/2022 Hsieh ..... B65D 43/162

* cited by examiner

*Primary Examiner* — Javier A Pagan
(74) *Attorney, Agent, or Firm* — WPAT, PC

(57) ABSTRACT

A tamper-evident container with a rotating lid is disclosed. The tamper-evident container includes a box body, the lid, and a pre-scored connecting portion connecting the box body and the lid. The horizontal end surface of the box body has a first locking portion, and the bottom surface of the lid has a second locking portion that can be detachably engaged with the first locking portion. When the lid is closed with the box body, the container is sealed. By breaking the pre-scored connecting portion, the lid can be horizontally rotated against the first locking portion and the second locking portion, so as to separate the lid from the box body. This structure allows for easy detection of tampering by observing the breakage of the pre-scored connecting portion and enables the container to remain open during use.

16 Claims, 15 Drawing Sheets

TAMPER-EVIDENT CONTAINER WITH ROTATING LID

BACKGROUND OF THE INVENTION

1. Technical Field

The present invention relates to containers, and more particularly to a tamper-evident container with a rotating lid.

2. Description of Related Art

The long-lasting pandemic changed how people eat and many former regular diners are now loyal customers of food delivery services. Consequently, even in the "after" phase of the pandemic, food delivery still plays a key role in the catering market.

With the surge of transactions, disputes about delivery services increase. For example, some consumers complained that delivery drivers opened and sneaked their orders. Such an accusation is however hard to be ascertained because many food containers are not sealed. Similar cases can also be seen in supermarkets/hypermarkets, as food products packaged with containers may be opened or broken stealthily by unauthorized people without being noted by people buy the products later.

These issues reflect some shortcomings of the existing food containers. First, if a delivered or sold product has previously been maliciously unsealed and/or contaminated, a consumer taking it without any precautions may be exposed to health hazards, such as sitotoxism, and this goes against consumer rights on intactness and safety of food. Moreover, since consumers' loyalty and trust to brands are always based on quality and safety of products, any food product that is doubtable in terms of quality and safety will eventually be spurned by consumers.

Additionally, most existing food containers are made as disposable one-piece meal boxes. Since the lid and the box body are simply y connected without having any pivot therebetween, the lid flipped up, after the flipping force disappears, will drop back toward the box body by gravity unless the user keeps pushing or uses an external object to hold the lid in the open position. Thus, use of the conventional container is far from convenient.

In view of this, improvement of the conventional food containers is desirable.

SUMMARY OF THE INVENTION

A primary objective of the present invention is to solve the issues of conventional food containers by protecting a container from being secretly unsealed and ensuring that the opened lid remains in the open position to allow easy access to the food in the opened container.

To achieve the foregoing objective, one embodiment of the present invention provides a tamper-evident container with a rotating lid. The container comprises a box body, the lid, and a pre-scored connecting portion. The box body defines therein an accommodating space. The box body has a horizontal end surface provided with a first locking portion. The accommodating space has a first combining unit close to the horizontal end surface of the box body. The lid has a bottom surface provided with a second combining unit and a second locking portion. The second locking portion is locationally corresponding to the first locking portion and is for being engaged with the first locking portion. The second combining unit is to be detachably fit into the first combining unit so as to seal the accommodating space. The pre-scored connecting portion connects between the box body and the lid. The pre-scored connecting portion is located remote from the first locking portion and the second locking portion. When the pre-scored connecting portion is broken and the second combining unit and the first combining unit are separated from each other, the second locking portion is allowed to be horizontally rotated with respect to the first locking portion.

Thereby, after food is placed into the box body and the lid is combined with the box body, the tamper-evident container is sealed for safe delivery. A user receiving the delivery can only open the container by removing the pre-scored connecting portion between the lid and the box body and then rotating the lid away from the box body. Since the lid is horizontally rotated away from the box body, it will not fall back to the box body due to the gravity. In addition, by rotating the first locking portion with respect to the second locking portion to open and close the container, the container can be reused.

DETAILED DESCRIPTION OF THE INVENTION

Figure 1:
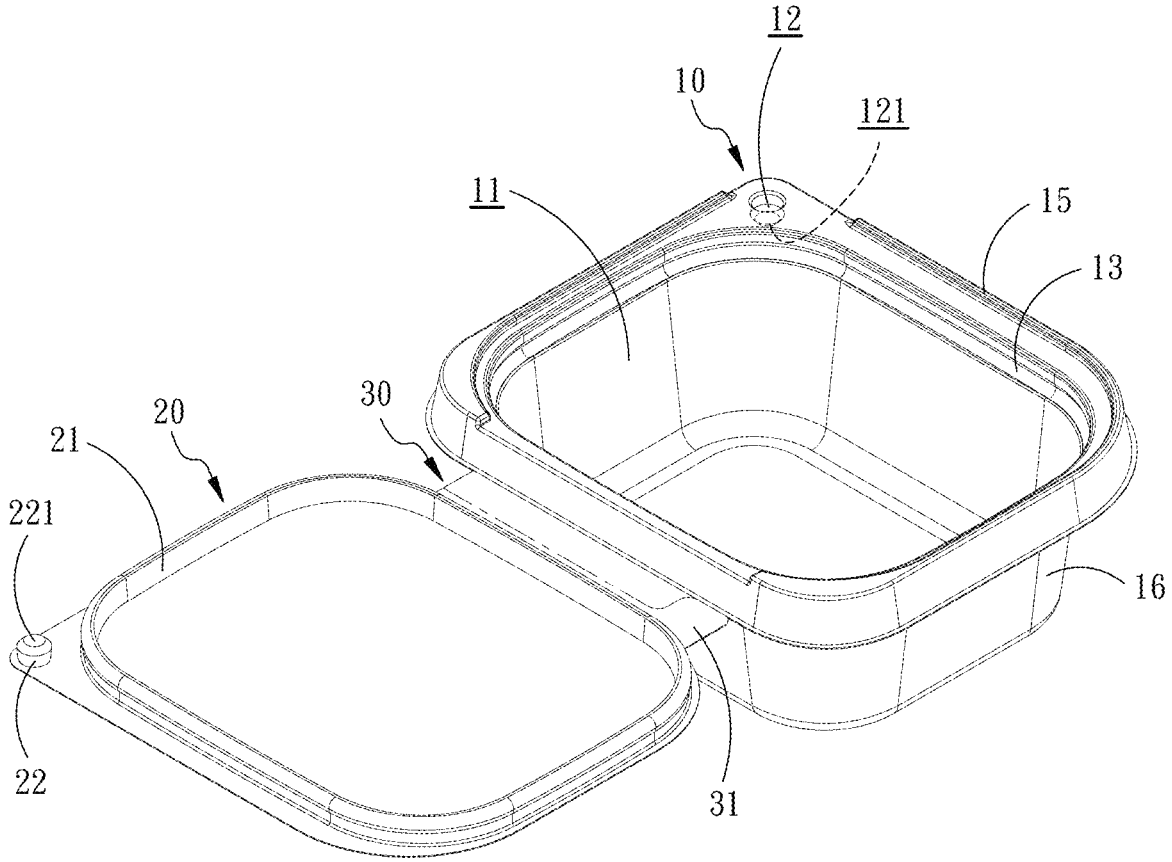
FIG. 1 is a perspective view of a container according to a first embodiment of the present invention, wherein the lid has been opened.

For further illustrating the means and functions by which the present invention achieves the certain objectives, the following description, in conjunction with the accompanying drawings and preferred embodiments, is set forth as below to illustrate the implement, structure, features and effects of the subject matter of the present invention.

Referring to FIG. 1 through FIG. 15, the present invention provides a tamper-evident container with a rotating lid, comprising a box body 10, a lid 20, and a pre-scored connecting portion 30. The box body 10 defines an accommodating space 11. The box body 10 has its horizontal end surface provided with a first locking portion 12. The first locking portion 12 in the present embodiment is a column-like socket and has an inner diameter that is constant or is gradually enlarged as the first locking portion 12 extends away from its free end. A first combining unit 13 is provided in the accommodating space 11 and close to the horizontal end surface of the box body 10. The first combining unit 13 in the present embodiment is a stepped recess. The lid 20 has its bottom surface provided with a second combining unit 21 and a second locking portion 22. The second locking portion 22 in the present embodiment is formed as a column-like boss and has an outer diameter that is constant or is gradually enlarged as the second locking portion 22 extends toward its free end. The second locking portion 22 is locationally corresponding to the first locking portion 12 so as to be fittingly combined with the first locking portion 12 and thereby firmly hold the box body 10 and the lid 20 together. In addition, if the second locking portion 22 is tapered away from its free end, and the first locking portion 12 is tapered toward its free end, it would be difficult to combine the second locking portion 22 with the first locking portion 12. Moreover, after the second locking portion 22 and the first locking portion 12 are combined, it would be even more difficult to pull the second locking portion 22 out of the first locking portion 12. With this configuration, a tricky attempt to forcedly push the second locking portion 22 out by applying a force to the bottom of the first locking portion 12 is unlikely to succeed. The second combining unit 21 in the present embodiment is a raised circular portion. The second combining unit 21 is to be detachably fit into the first combining unit 13 in the form of the stepped recess, so as to thereby seal the accommodating space 11. The pre-scored connecting portion 30 is connected between the box body 10 and the lid 20, and is located at the side remote from the first locking portion 12 and the second locking portion 22. When the pre-scored connecting portion 30 breaks and separation between the second combining unit 21 and the first combining unit 13 happens, the second locking portion 22 can be horizontally rotated against the first locking portion 12.

Thereby, when the lid 20 is closed to the box body 10, and the first combining unit 13 is combined with the second combining unit 21, the box body 10 is sealed. Combination between the first locking portion 12 and the second locking portion 22 effectively prevents that the lid 20 and the box body 10 separate from each other. In virtue of the almost impregnable combination between the first locking portion 12 and the second locking portion 22, the only practical way to open the sealed container is to break the pre-scored connecting portion 30 and pull the lid 20 away from the body box 10 upward from the broken pre-scored connecting portion 30 until the first combining unit 13 and the second combining unit 21 separate from each other. At this time, the lid 20 can be horizontally rotated to expose the accommodating space 11.

Furthermore, since the lid 20 is horizontally rotated away from the box body 10, opposite to the prior-art cover that can easily drop by gravity and needs additional positioning means, the lid 20 can stay at the open position without hindering the user from accessing food in the accommodating space 11.

Still referring to FIG. 1, the free end of the second locking portion 22 is formed with a tapered end 221 and the first locking portion 12 has a tapered recess 121 at its bottom edge. After the tapered end 221 is fit in the tapered recess 121, the first locking portion 12 and the second locking portion 22 are firmly combined.

Figure 2:
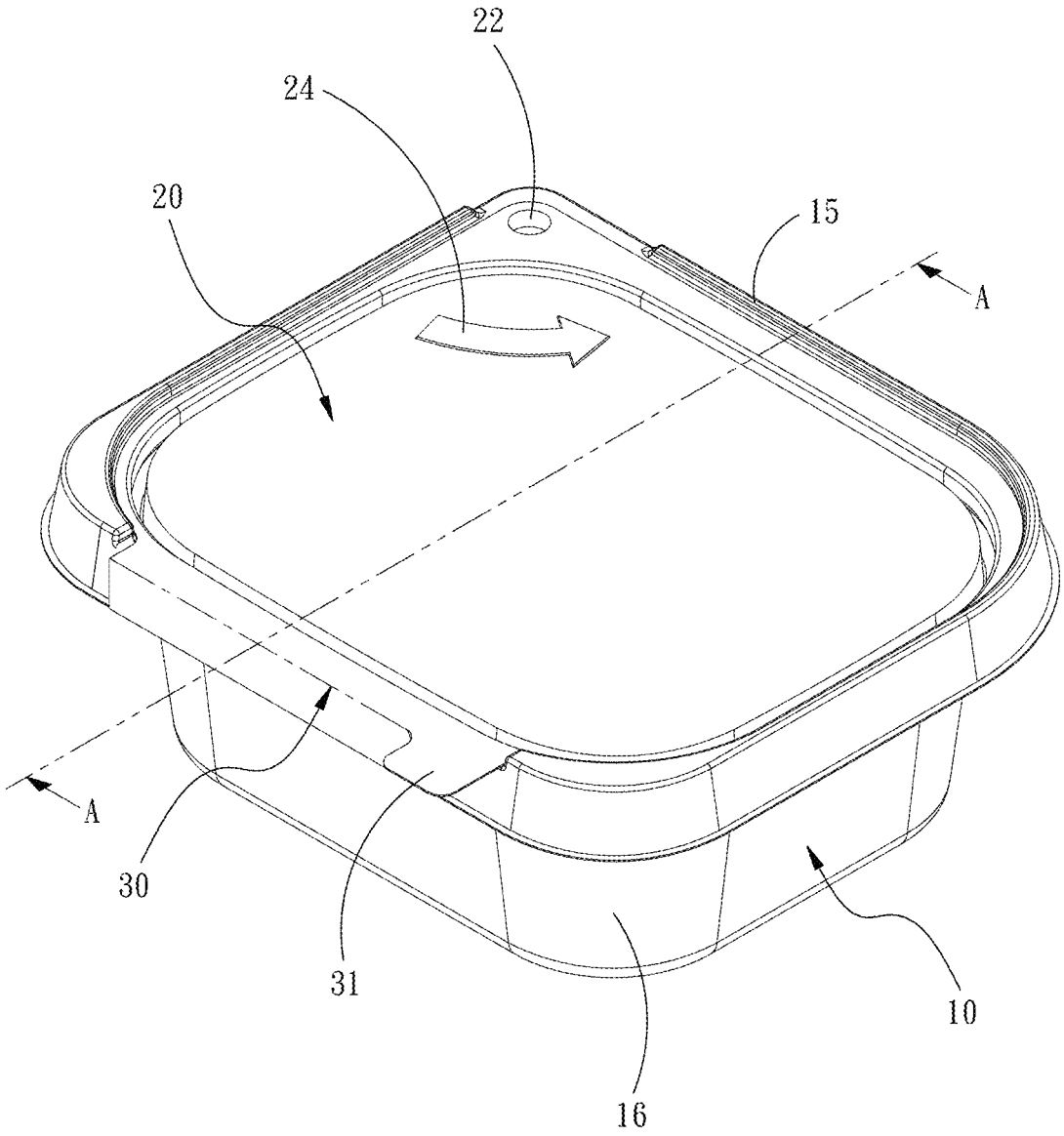
FIG. 2 is another perspective view of the container of FIG. 1, wherein the lid has been closed.

Referring to FIG. 2, a prompt unit 24 is provided at the surface of the lid 20 to prompt the user the recommended direction for rotating the lid 20 to expose the accommodating space 11 of the box body 10 after the pre-scored connecting portion 30 is broken.

Still referring to FIG. 2, a retaining ridge 15 is provided at the top edge of the box body 10 without contacting the first locking portion 12. When the lid 20 is closed to the box body 10, the retaining ridge 15 is higher than the periphery of the lid 20. Thereby, when the lid 20 is closed to the box body 10, it would be difficult for a person to open the container by trying to pry the lid 20 at its periphery.

Figure 3:
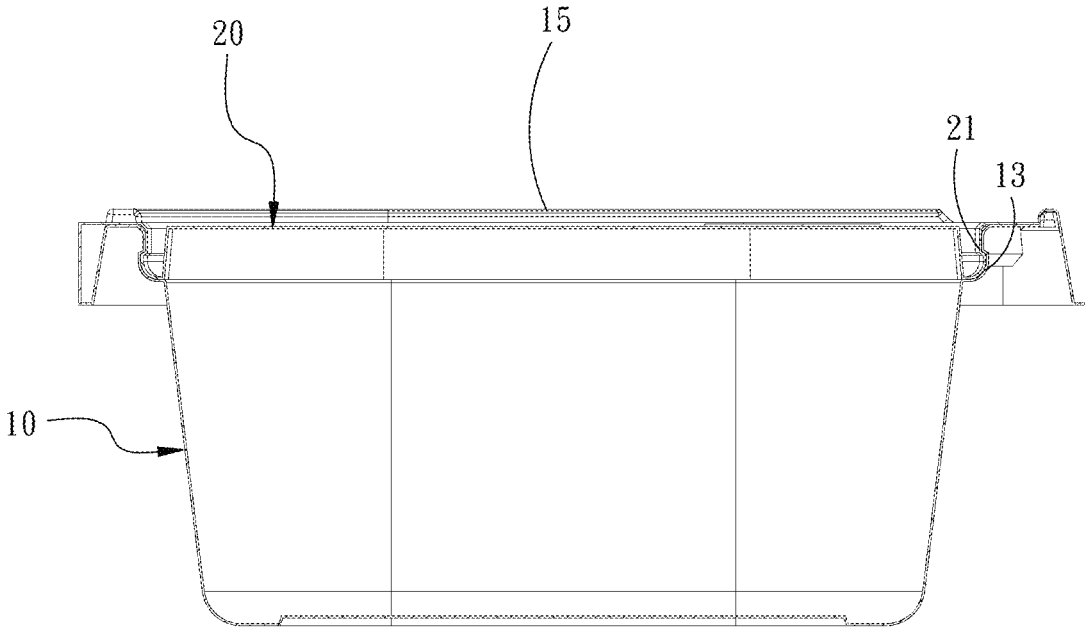
FIG. 3 is a cross-sectional view of the container of FIG. 1, taken along Line A-A of FIG. 2.
Figure 4:
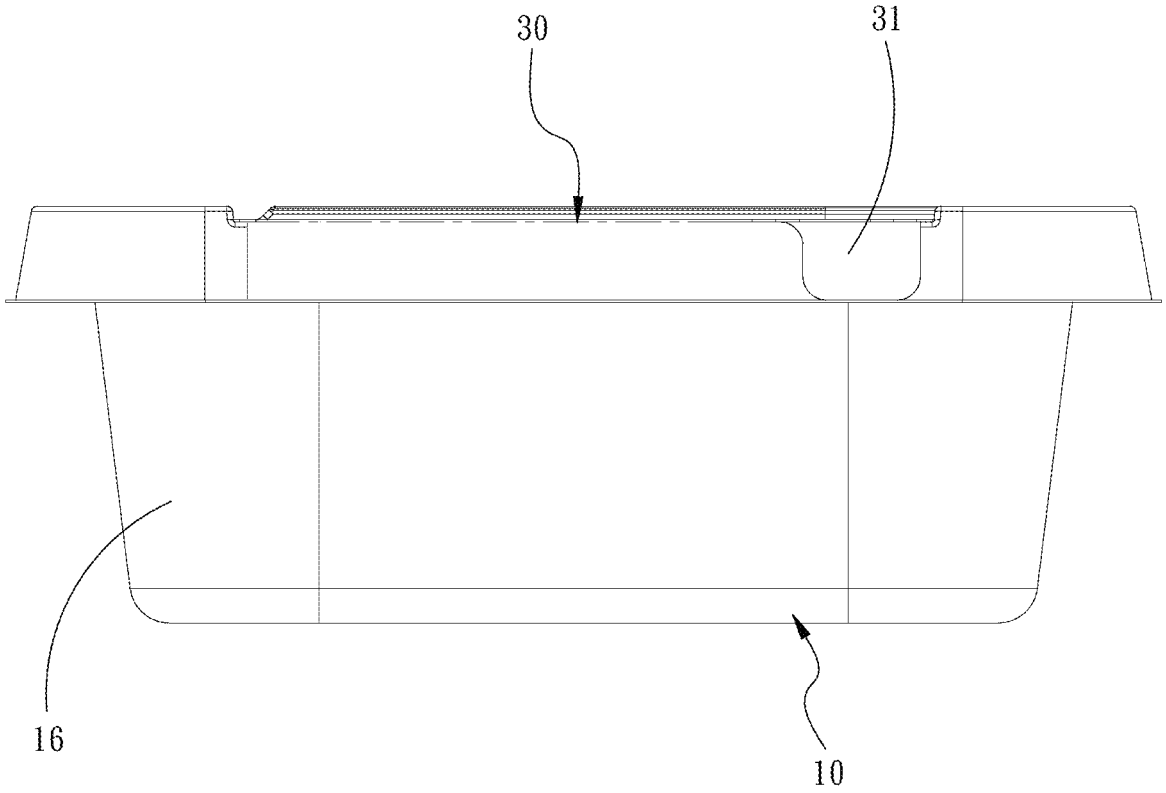
FIG. 4 depicts the container in FIG. 2 from a different angle of view.
Figure 5:
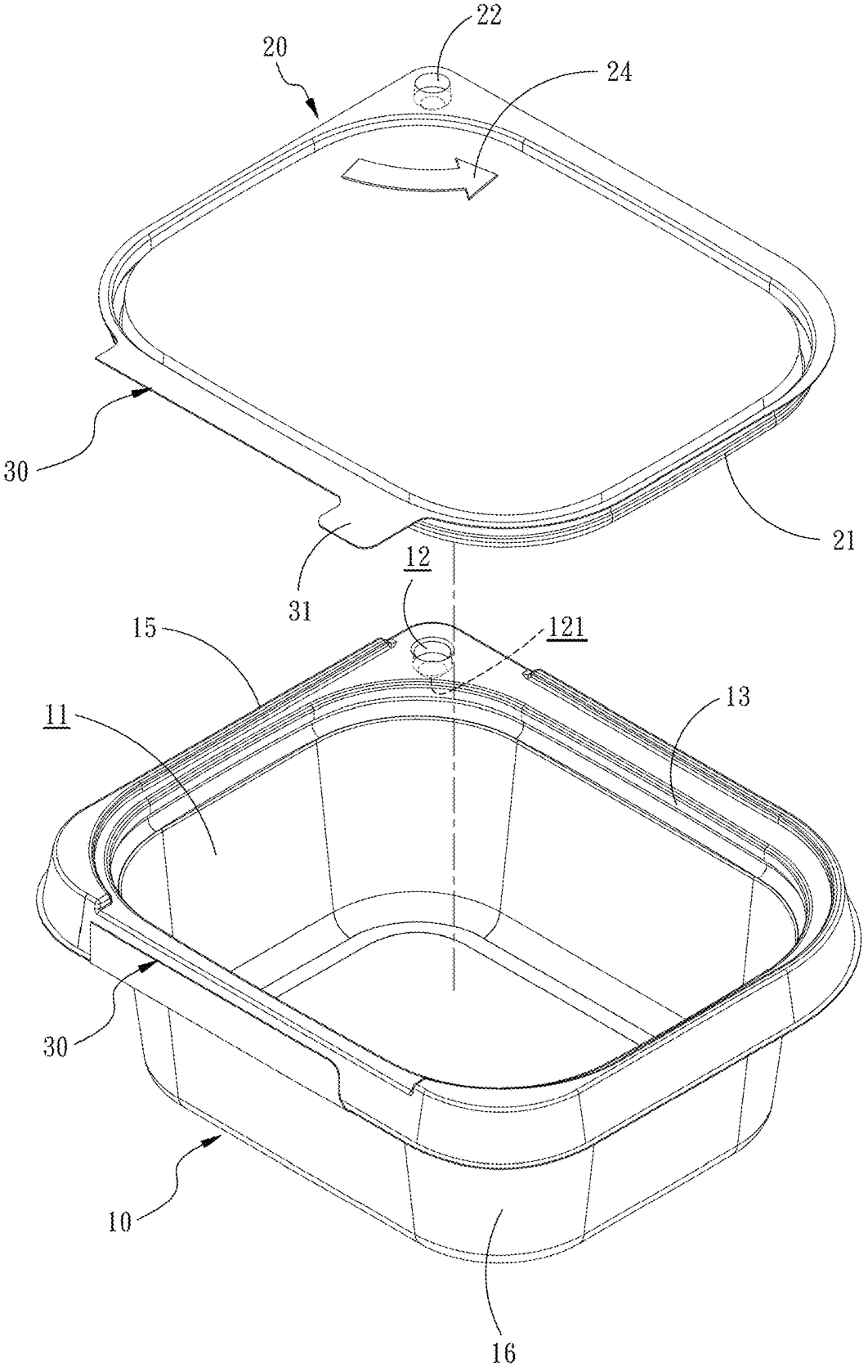
FIG. 5 is another perspective view of the container of FIG. 1 showing that the lid has been detached from the box body.
Figure 6:
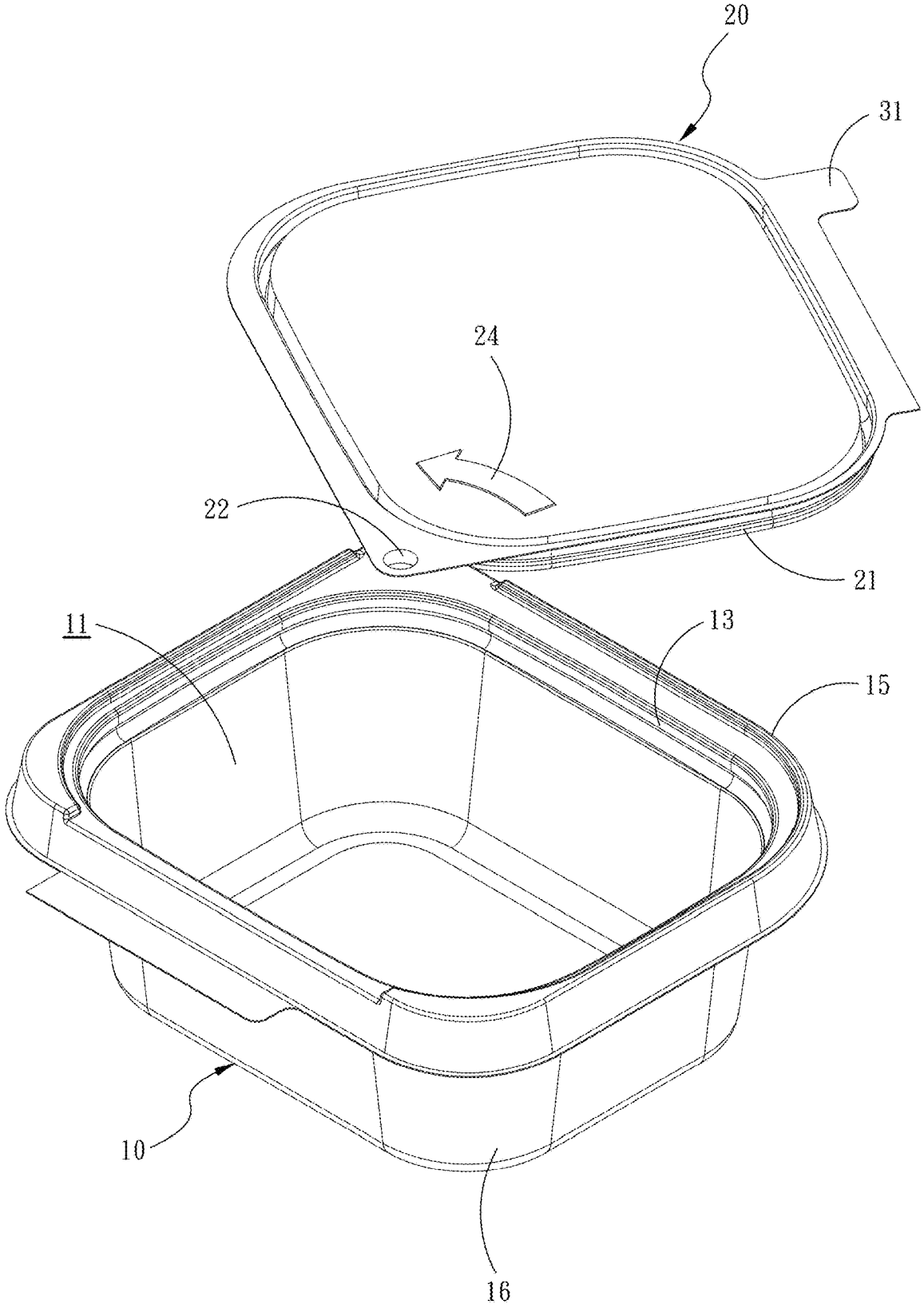
FIG. 6 is another perspective view of the container of FIG. 1 showing that the lid has been rotated away from the box body.

Referring to FIG. 2 through FIG. 4, and also FIG. 1, in one embodiment, the pre-scored connecting portion 30 has its one end formed with a tab 31. When the lid 20 is closed to the box body 10, the tab 31 cocks up besides the lid 20. The tab 31 has a curved periphery. The tab 31 serves to facilitate tearing up the pre-scored connecting portion 30. Moreover, by grabbing the tab 31, a user can pull up the lid 20 easily to separate the first combining unit 13 from the second combining unit 21. Therein, the tab 31 may be alternatively provided at an arbitrary position along the lateral of the lid 20 and its arrangement is not limited to the ends or the center of the lid 20.

Figure 7:
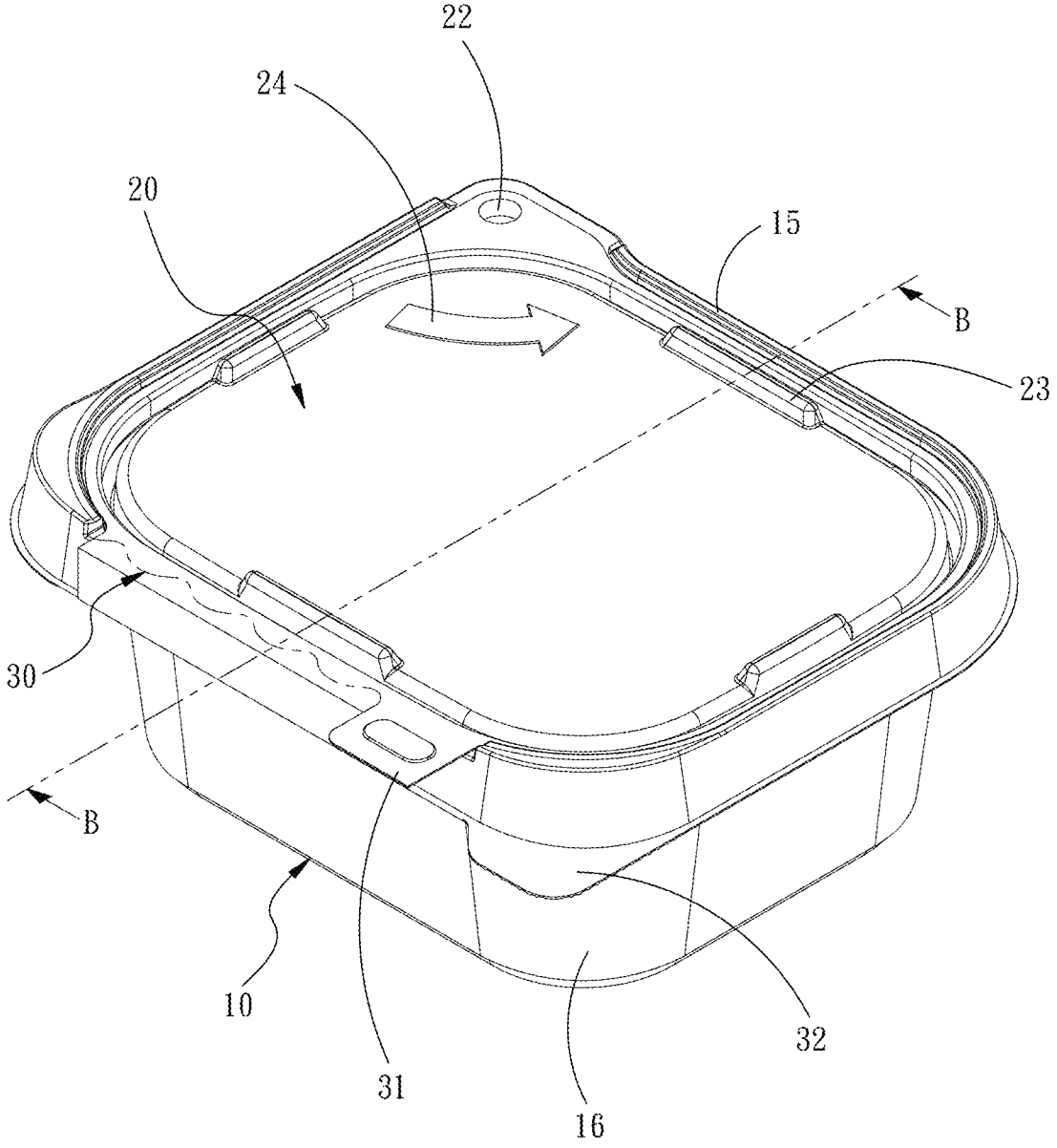
FIG. 7 is a perspective view of a container according to a second embodiment of the present invention, wherein the lid has been closed.
Figure 8:
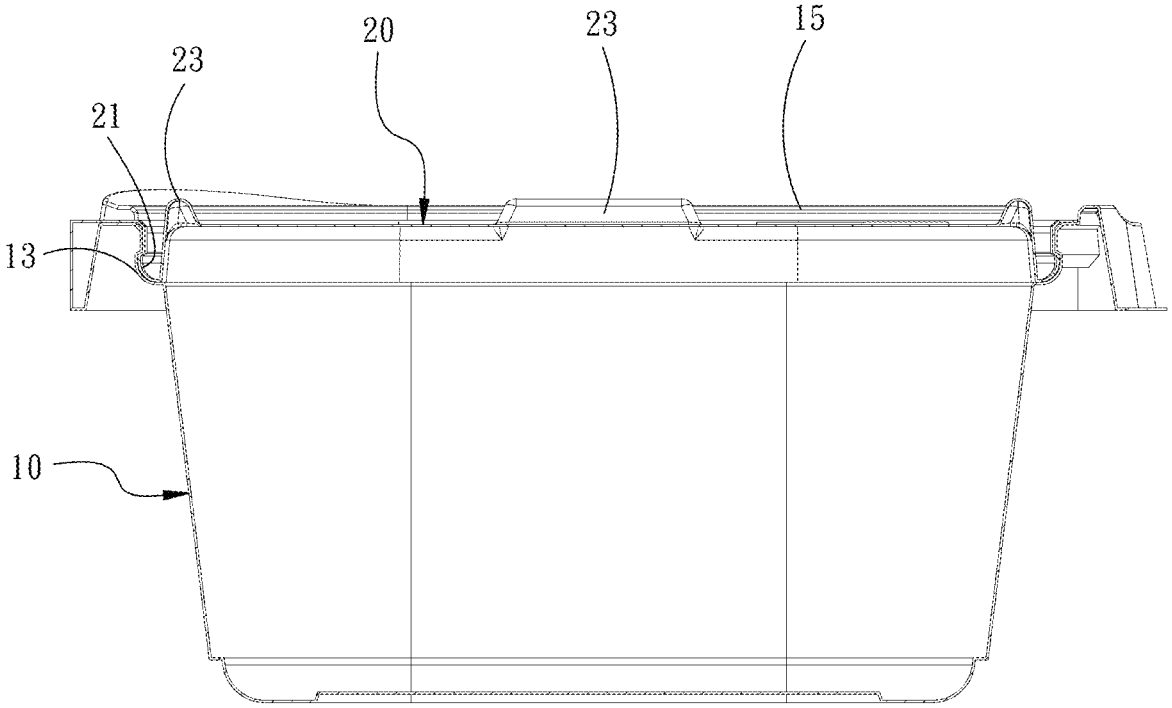
FIG. 8 is a cross-sectional view of a first aspect of the present invention taken along Line B-B of FIG. 7.

Referring now to FIG. 2 and FIG. 7, the pre-scored connecting portion 30 may be made to be straight or wavy. As shown in FIG. 7, when it is made as a wavy line, it may have a smooth profile without any acute angles. With such a design, the risk that the torn pre-scored connecting portion 30 cuts the user can be eliminated, thereby improving use safety.

Figure 15:
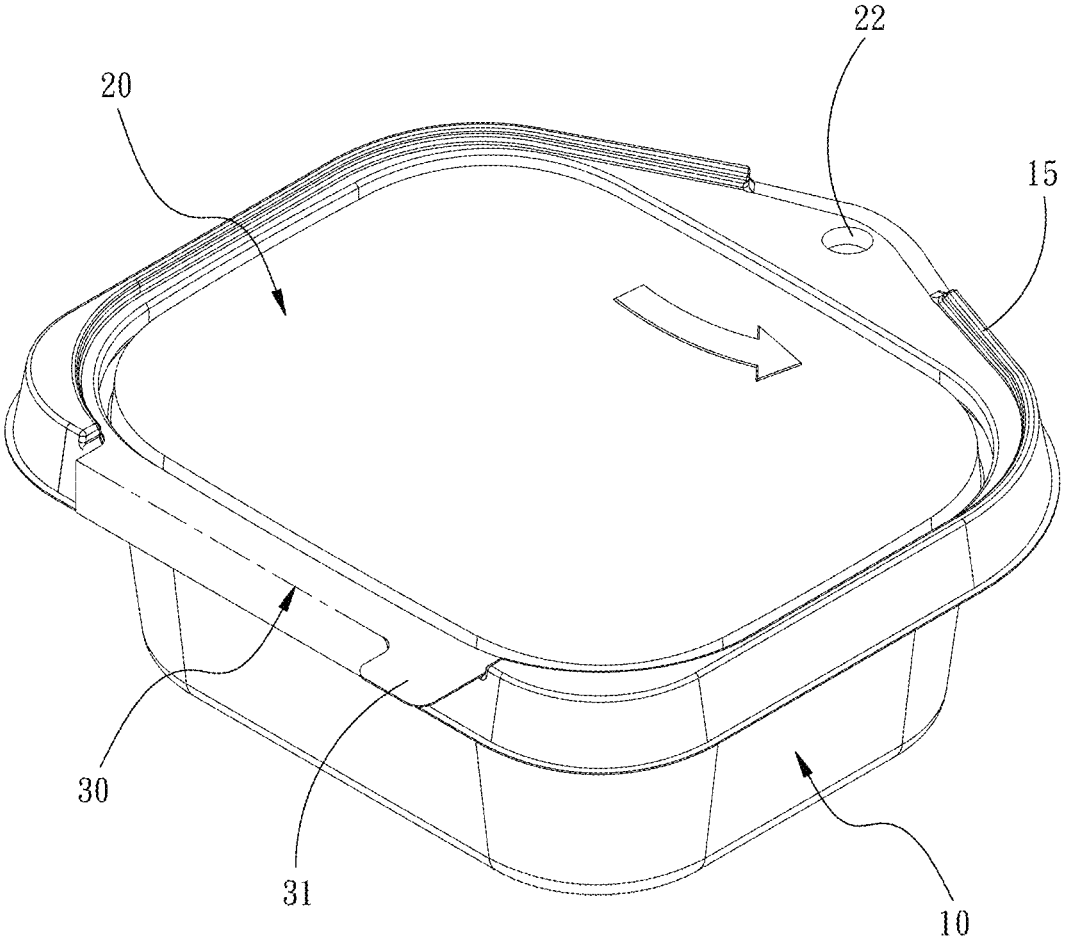
FIG. 15 is a perspective view of a container according to a fourth embodiment of the present invention, wherein the second locking portion is at the middle of an edge of the lid.

Instead of being located at the corner of the box body 10 remote from the pre-scored connecting portion 30 as shown in FIG. 1, the first locking portion 12 in another embodiment may alternatively be located at the middle of the edge of the box body 10 remote from the pre-scored connecting portion 30 (as shown in FIG. 15), so that the lid 20 and the box body 10 are connected and can be rotated with respect to each other in a symmetrical and balanced manner.

Now referring to FIG. 7 through FIG. 11, in the second embodiment, the lid 20 has its top surface formed with a plurality of retaining bars 23. These retaining bars 23 are to be engaged with the bottom surface of the box body 10 of another container of the present invention so as to hold the box body 10 in position firmly. With this configuration, plural containers of the present invention stacked vertically can be handled and/or stored stably for safe transportation and easy storage.

Figure 9:
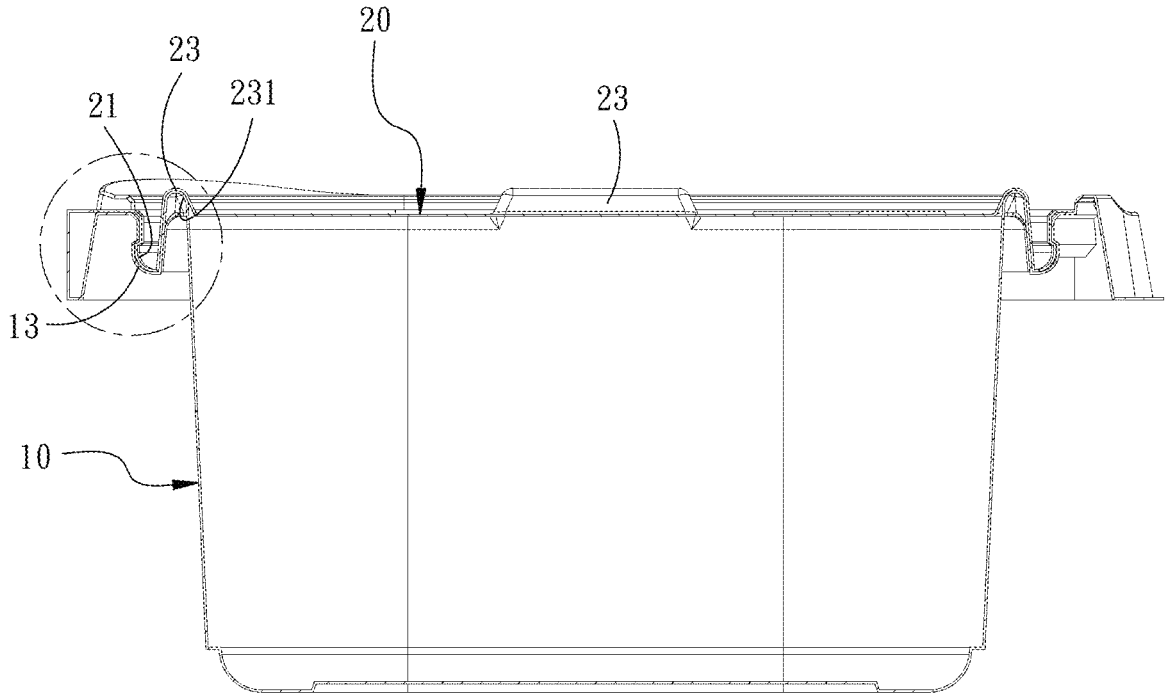
FIG. 9 is a cross-sectional view of a second aspect of the present invention taken along Line B-B of FIG. 7.
Figure 10:
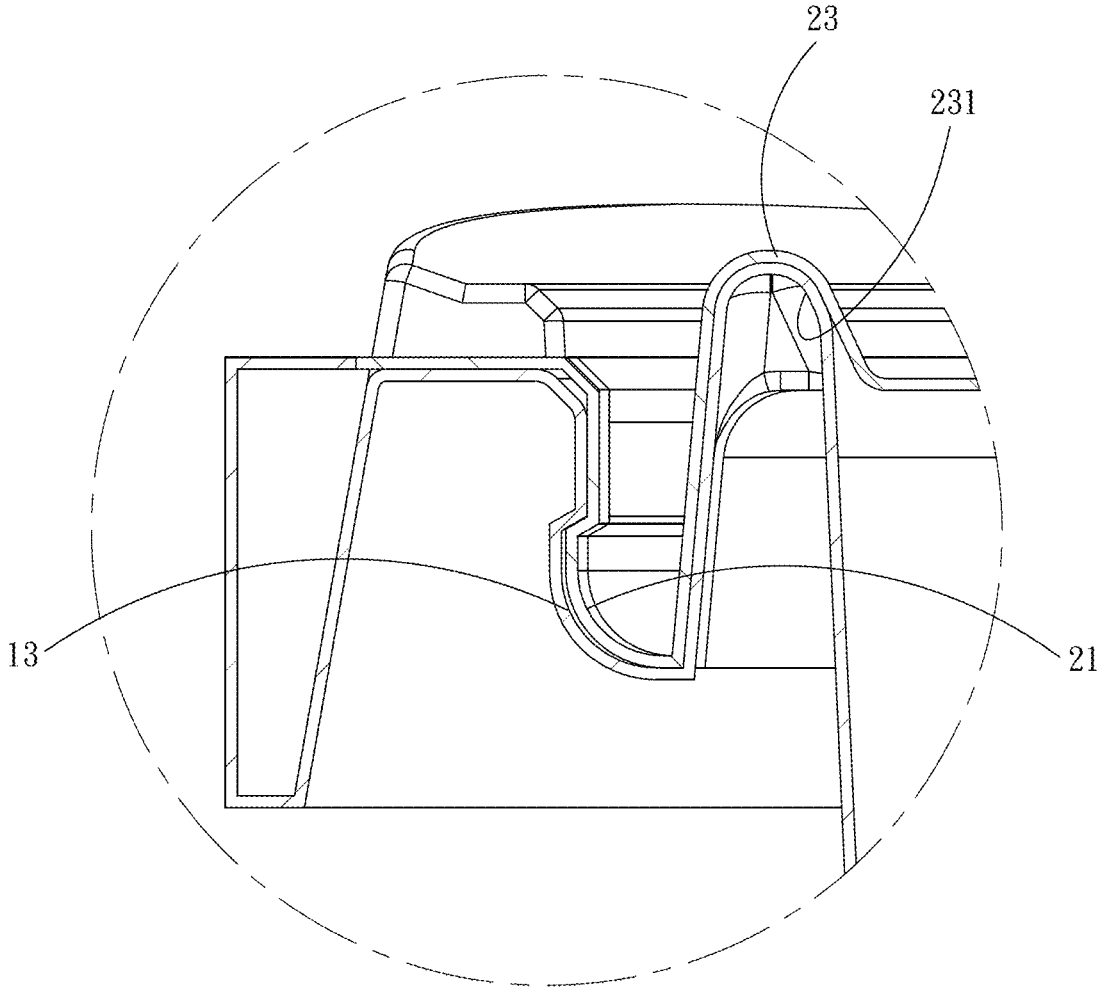
FIG. 10 is a partial, zoomed-in view of FIG. 9.
Figure 11:
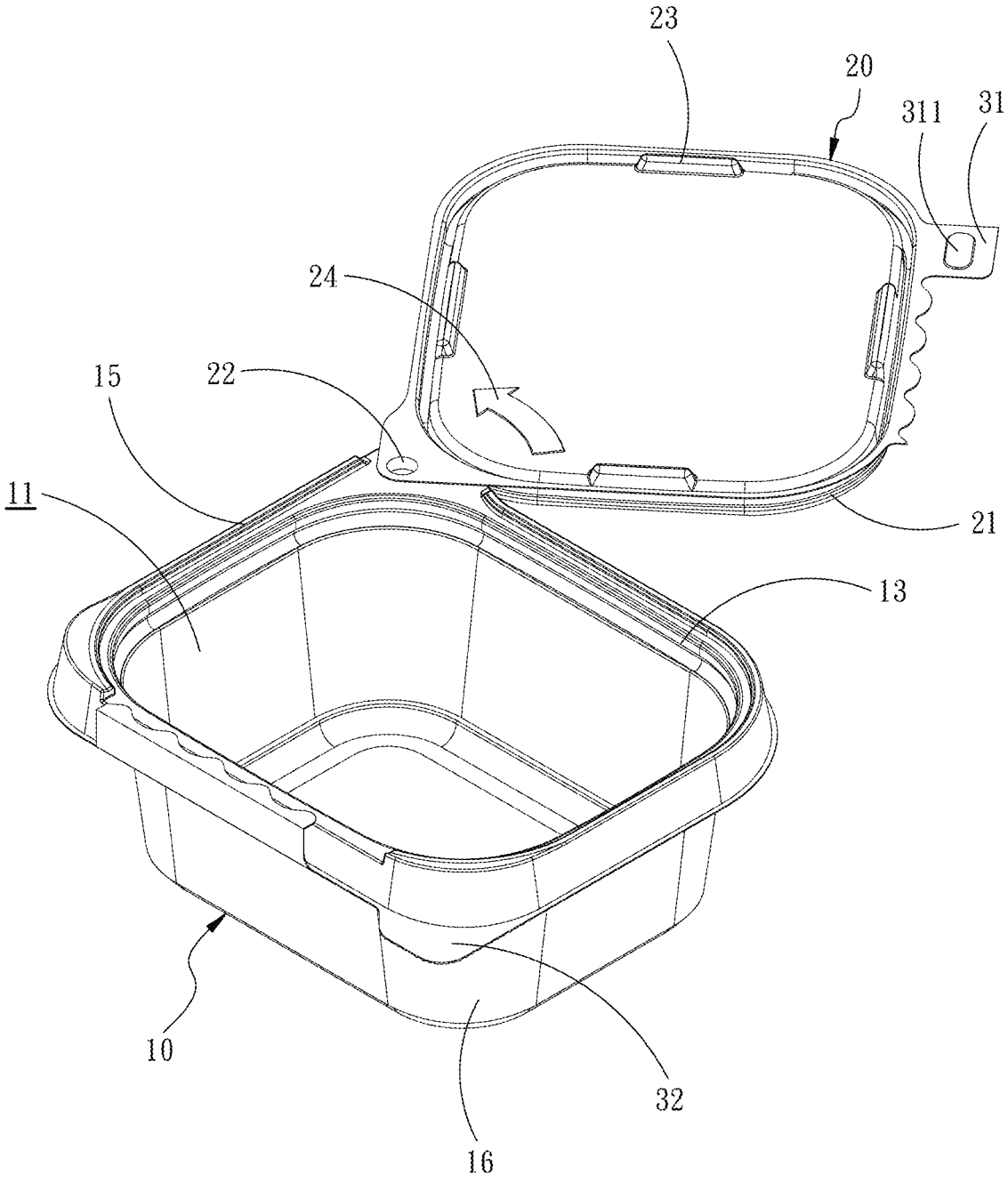
FIG. 11 is another perspective view of the container of FIG. 7, wherein the lid has been rotated away from the box body.

Referring to FIG. 9 and FIG. 10, the box body 10 is provided with a plurality of retaining portions 231 locationally corresponding to the retaining bars 23 of the lid 20. The retaining portions 231 are to be engaged with the retaining bars 23 of the lid 20, so as to strengthen tightness between the lid 20 and the box body 10, and enhance the sealing performance of the container.

Figure 12:
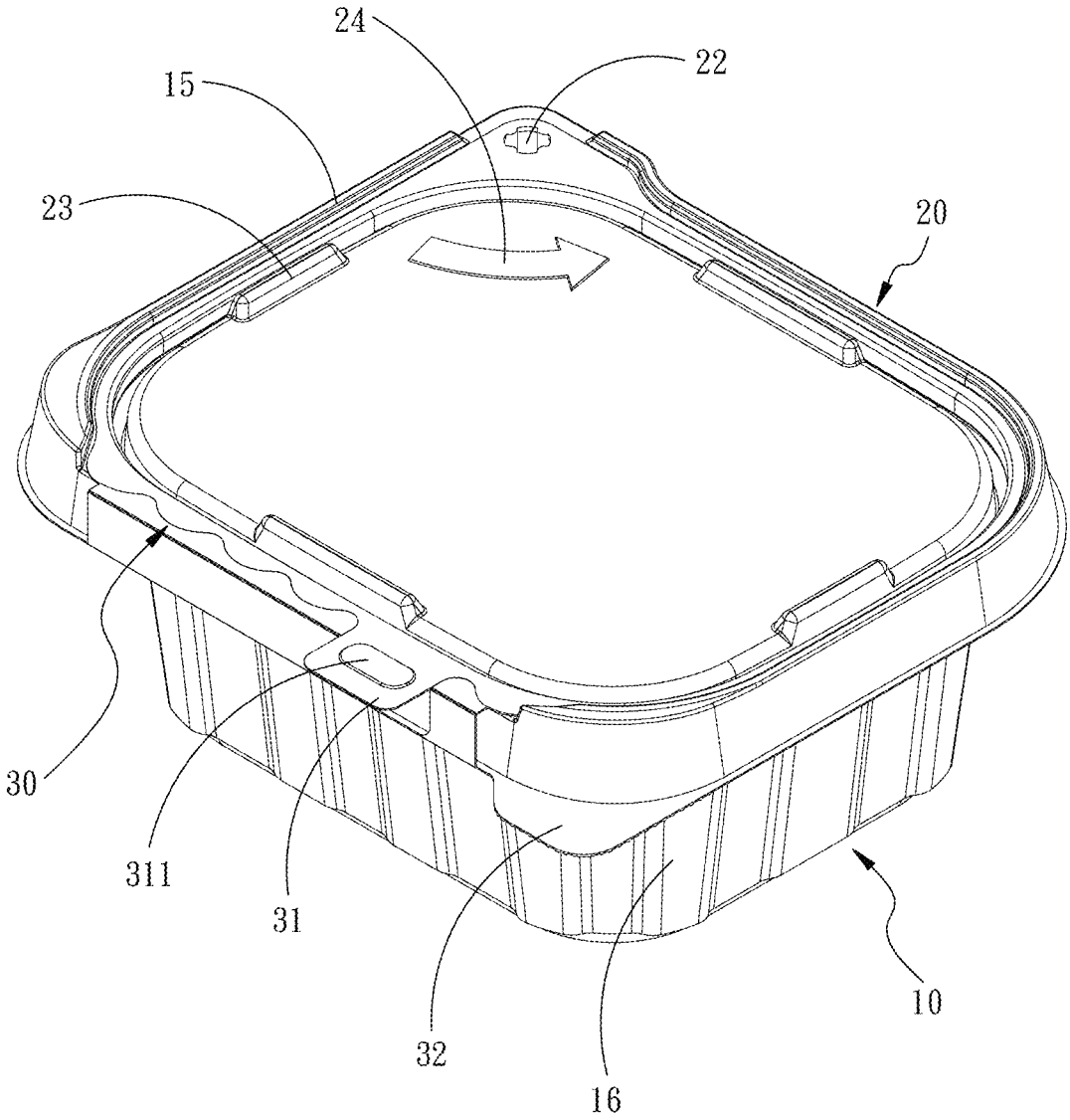
FIG. 12 is a perspective view of a container according to a third embodiment of the present invention, wherein the lid has been closed.
Figure 13:
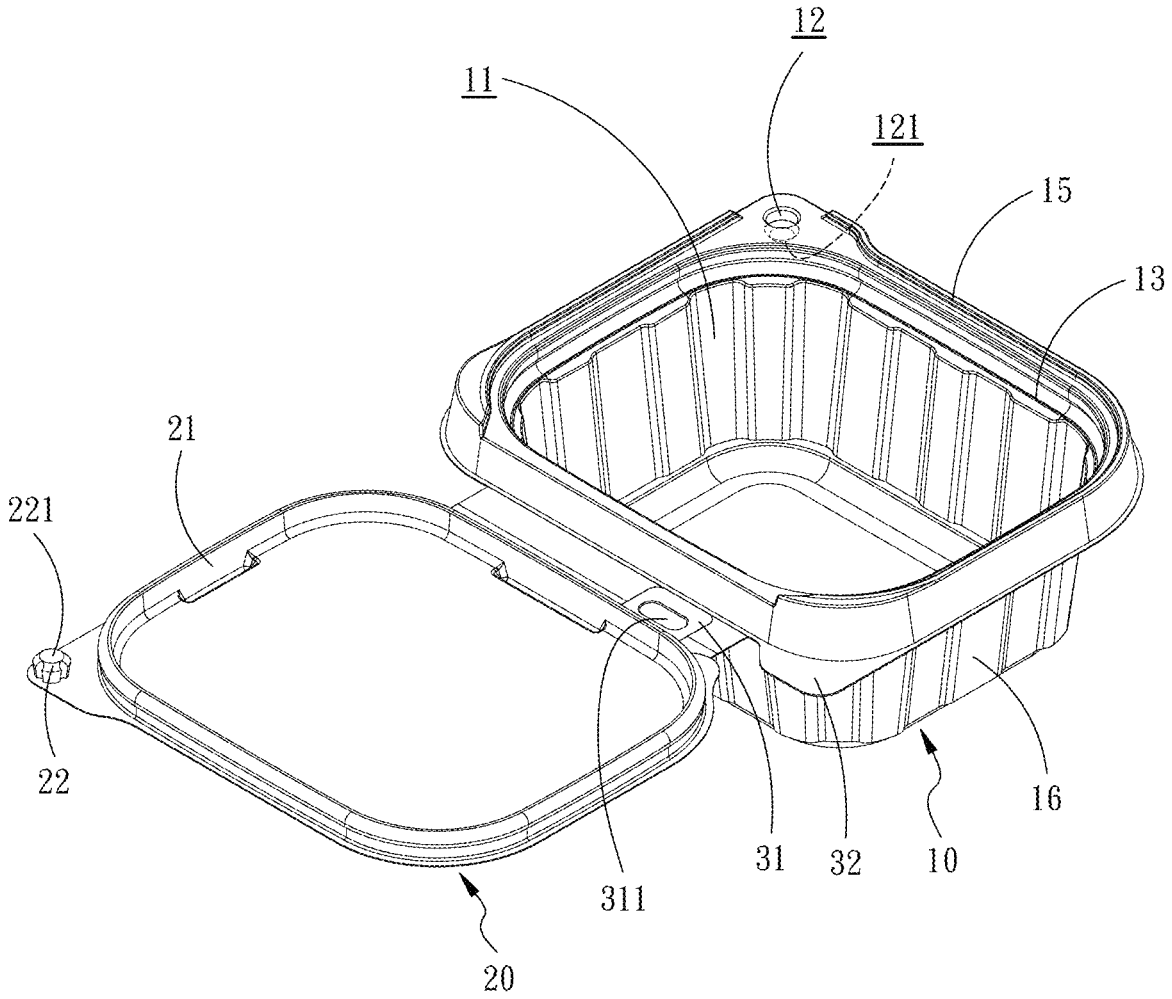
FIG. 13 is another perspective view of the container of FIG. 12, wherein the lid has been opened.
Figure 14:
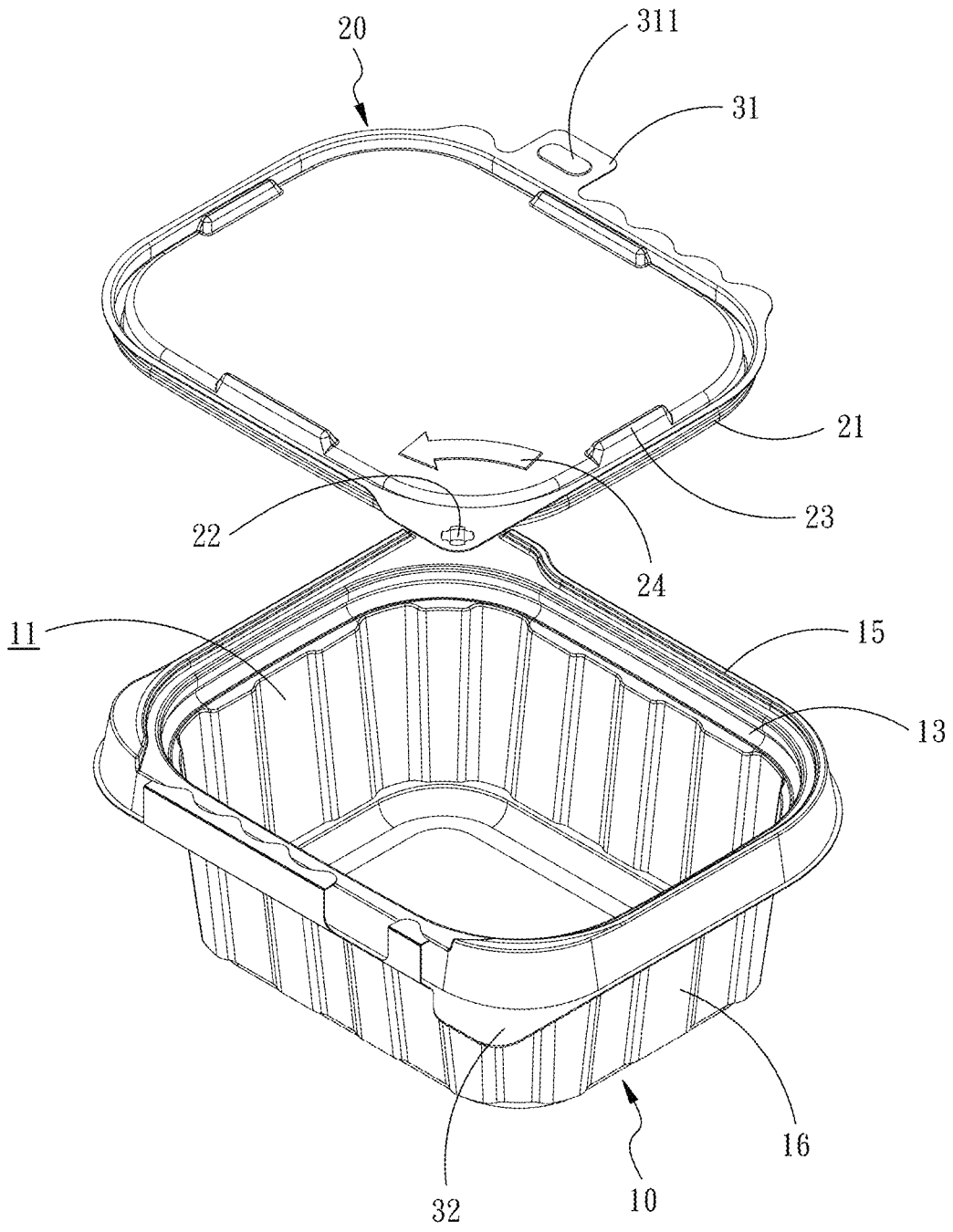
FIG. 14 is another perspective view of the container of FIG. 12, wherein the lid has been rotated away from the box body.

Referring to FIG. 12 through FIG. 14, in the third embodiment of the present invention, the second locking portion 22 is formed as a boss that has a cross-shaped section, and the first locking portion 12 is formed as a correspondingly shaped socket. With the cross-shaped section, the second locking portion 22 has improved structural resilience, making it easier to combine the second locking portion 22 and the first locking portion 12. Additionally, the cross-shaped boss of the second locking portion 22 may be tapered away from the free end, and the first locking portion 12 is tapered toward the free end. While these configurations add difficulty in combining the second locking portion 22 and the first locking portion 12, they can effectively secure the combination by preventing the second locking portion 22 from being pulled out of the first locking portion 12. Even a tricky attempt to forcedly push the second locking portion 22 out by applying a force to the bottom of the first locking portion 12 is unlikely to succeed. In other words, the second locking portion 22 formed as the cross-shaped boss is easier to combine with the first locking portion 12 as compared to the second locking portion 22 of the previous embodiment formed as a column-like boss, yet the resulting combination of the first locking portion 12 and the second locking portion 22 achieves the comparable tightness and security, thereby providing a preferrable effect of combination and temper-evidence.

Still referring to FIG. 12 through FIG. 14, the box body 10 is further provided with a lug 32 that is close to the tab 31. The lug 32 facilitates force application. The tab 31 is provided with a force application portion 311 for providing frictional resistance. As shown, the force application portion 311 has its side facing the tab 31 formed as a bulged surface and has the opposite side formed as a recessed surface, so as to ensure good friction for a user to easily apply a pulling force when pulling the tab 31. Alternatively, the force application portion 311 may be provided with grooves or nodules to similarly provide frictional resistance. With these configurations, a user can hold the lug 32 with one hand and grab and pull the tab 31 with the other hand to remove the pre-scored connecting portion 30.

FIG. 15 depicts the fourth embodiment of the present invention. Therein, the second locking portion 22 is located at the middle of an edge of the lid 20. Although this is not shown, the first locking portion 12 is located on the box body 10 to be locationally corresponding to the second locking portion 22.

In one embodiment, the box body 10 has its lateral walls each provided with reinforcing ribs 16 that are formed by folding the material of the box body 10. The reinforcing ribs 16 enable the box body 10 to have increased structural strength without increasing its thickness. In other words, with the same material weight and manufacturing costs, the rib-equipped box body 10 is less likely to collapse than its plain counterpart.

In virtue of the foregoing features, the present invention provides the following advantages:

1. Easy tamper detection: with provision of the pre-scored connecting portion 30, any attempt to open the lid 20 will break the pre-scored connecting portion 30, and this makes it impossible for an unauthorized person to open the lid 20 and access and/or tamper objects in the box body 10 secretly.

2. Convenient use: the lid 20 that has been opened through removal of the pre-scored connecting portion 30 and horizontal rotation with respect to the box body 10 can stay still in the open position, and this saves a user from the trouble of using additional means or efforts to make the lid 20 remain open.

3. Reliable combination: the tapered recess 121 and the tapered end 221 jointly secure the combination between the first locking portion 12 and the second locking portion 22, and in turn guarantee reliable combination between the lid 20 and the box body 10. Even when the lid 20 is being rotated, the lid 20 and the box body 10 can be well combined and are unlikely to depart from each other.

4. Difficulty in removing the lid 20: with the second locking portion 22 formed as the cross-like boss that is tapered away from the free end, it is almost impossible to open the sealed container by detaching the second locking portion 22 from the first locking portion 12 without breaking the container.

5. Effortless removal of the pre-scored connecting portion 30: by grabbing the tab 31 having the curved periphery, a user can pull up and remove the pre-scored connecting portion 30 safely. Additionally, the force application portion 311 optionally provided on the tab 31 makes it easy for the user to apply force and remove the pre-scored connecting portion 30 effortlessly.

6. Stackability: provision of the retaining bars 23 allows the container of the present invention to be stacked with good stability, thereby facilitating handling, transportation, and storage.

7. Good tightness: in addition to the combination between the first combining unit 13 and the second combining unit 21, the matching retaining bars 23 and retaining portions 231 further secure the combination of the box body 10 and the lid 20, so the closed container is more structurally stable and has good tightness and sealing performance.

8. High structural strength: the reinforcing ribs 16 at the lateral walls of the box body 10 enhance the structural strength of the box body 10, thereby making the box body 10 more durable and better load-bearing.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A tamper-evident container with a rotating lid, comprising:

a box body, defining therein an accommodating space, and having a horizontal end surface provided with a first locking portion, wherein a first combining unit is provided in the accommodating space close to the horizontal end surface of the box body;

the lid, having a bottom surface provided with a second combining unit and a second locking portion, wherein the second locking portion is locationally corresponding to the first locking portion and configured to be engaged with the first locking portion, and the second combining unit is configured to be detachably fit into the first combining unit so as to seal the accommodating space; and a pre-scored connecting portion, connecting between the box body and the lid and being located remote from the first locking portion and the second locking portion;

whereby when the pre-scored connecting portion is broken and the second combining unit and the first combining unit are separated from each other, the second locking portion is allowed to be horizontally rotated with respect to the first locking portion.

2. The tamper-evident container of claim 1, wherein the second locking portion is formed as a column-like boss, and the first locking portion is formed as a column-like socket matching the second locking portion.

3. The tamper-evident container of claim 1, wherein the second locking portion is formed as a cross-shaped boss, and the first locking portion is formed as a cross-shaped socket matching the second locking portion.

4. The tamper-evident container of claim 1, wherein the second locking portion is tapered away from a free end thereof, and the first locking portion is tapered toward a free end thereof.

5. The tamper-evident container of claim 4, wherein the free end of the second locking portion is formed with a tapered end, and the first locking portion has a bottom edge correspondingly provided with a tapered recess.

6. The tamper-evident container of claim 5, wherein the first locking portion is located at a corner of the box body remote from the pre-scored connecting portion.

7. The tamper-evident container of claim 5, wherein the first locking portion is located at a middle of an edge of the box body remote from the pre-scored connecting portion.

8. The tamper-evident container of claim 5, wherein the pre-scored connecting portion has one end provided with a tab, so that when the lid is closed to the box body, the tab cocks up besides the lid.

9. The tamper-evident container of claim 8, wherein the tab has a curved periphery.

10. The tamper-evident container of claim 9, wherein the tab is provided with a force application portion for providing frictional resistance.

11. The tamper-evident container of claim 10, further comprising a retaining ridge that is provided at a top edge of the box body without contacting the first locking portion, so that when the lid is closed to the box body, the retaining ridge is higher than a periphery of the lid.

12. The tamper-evident container of claim 11, further comprising a plurality of retaining bars provided at a top surface of the lid for retaining a bottom surface of another said box body.

13. The tamper-evident container of claim 12, wherein the box body comprises a plurality of retaining portions locationally corresponding to the retaining bars of the lid, and the retaining portions are configured to be engaged with the retaining bars of the lid.

14. The tamper-evident container of claim 13, further comprising reinforcing ribs provided at lateral walls of the box body.

15. The tamper-evident container of claim 14, wherein the pre-scored connecting portion is made to be straight or wavy.

16. The tamper-evident container of claim 15, further comprising a prompt unit provided at the top surface of the lid.

* * * * *